US010883781B2

(12) United States Patent
Bowers et al.

(10) Patent No.: US 10,883,781 B2
(45) Date of Patent: Jan. 5, 2021

(54) CROSSBOW SAFETY SYSTEM

(71) Applicant: Hunter's Manufacturing Company, Inc., Suffield, OH (US)

(72) Inventors: Drew Bowers, Kettering, OH (US); Cassondra Faiella, Lewis Center, OH (US); Michael J. Shaffer, Mogadore, OH (US); Richard L. Bednar, Akron, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 16/436,146

(22) Filed: Jun. 10, 2019

(65) Prior Publication Data

US 2020/0158456 A1 May 21, 2020

Related U.S. Application Data

(63) Continuation of application No. 15/893,876, filed on Feb. 12, 2018, now Pat. No. 10,317,157.

(51) Int. Cl.

| | |
|---|---|
| ***F41B 5/12*** | (2006.01) |
| ***F41A 17/06*** | (2006.01) |
| ***F41A 17/22*** | (2006.01) |

(52) U.S. Cl.

CPC ..... *F41A 17/06* (2013.01); *F41A 17/066* (2013.01); *F41A 17/22* (2013.01); *F41B 5/12* (2013.01); *F41B 5/123* (2013.01)

(58) Field of Classification Search

CPC ..... F41A 17/06; F41A 17/066; F41A 17/20; F41A 17/22; F41B 5/12; F41B 5/1469

See application file for complete search history.

(56) References Cited

U.S. PATENT DOCUMENTS

| | | | |
|---|---|---|---|
| 2,092,361 | A | 9/1937 | Shim |
| 3,043,287 | A | 7/1962 | Nelson |
| 3,561,419 | A | 2/1971 | Cucuzza, Sr. |
| 3,670,711 | A | 6/1972 | Firestone |
| 3,739,765 | A | 6/1973 | Moore |

(Continued)

OTHER PUBLICATIONS

A Guide to the Crossbow, by W.F. Paterson, published by the Society of Archer-Antiquaries, 1990.

(Continued)

*Primary Examiner* — John A Ricci

(74) *Attorney, Agent, or Firm* — Emerson Thomson Bennett, LLC

(57) ABSTRACT

Provided is a crossbow safety system comprising a crossbow, a pressure sensor, and an interlock. The crossbow has a bowstring operable between a cocked and an uncocked position, a foregrip adapted for being grasped by an associated hand of an associated user, and a trigger assembly adapted to selectably retain the bowstring in the cocked position. The pressure sensor is on or in the foregrip, and is adapted to detect a pressure signature from the foregrip being grasped by an associated hand of an associated user, the associated hand having fingers. The interlock is operationally engaged with the pressure sensor and the trigger assembly, and is adapted to lock the trigger assembly from releasing the bowstring if the pressure sensor does not detect a first pressure signature sufficiently similar to a predetermined pressure signature.

20 Claims, 2 Drawing Sheets

(56) References Cited

U.S. PATENT DOCUMENTS

| | | | | |
|---|---|---|---|---|
| 4,192,281 | A | 3/1980 | King | |
| 4,246,883 | A | 1/1981 | Ash | |
| 4,593,675 | A | 6/1986 | Waiser | |
| 4,603,676 | A | 8/1986 | Luoma | |
| 4,649,892 | A | 3/1987 | Bozek | |
| 4,662,345 | A | 5/1987 | Stephens | |
| 4,665,885 | A | 5/1987 | Glomski et al. | |
| 4,719,897 | A | 1/1988 | Gaudreau | |
| 4,721,092 | A | 1/1988 | Waiser | |
| 4,942,861 | A | 7/1990 | Bozek | |
| 5,115,795 | A | 5/1992 | Farris | |
| 5,205,267 | A | 4/1993 | Burdick | |
| 5,215,069 | A | 6/1993 | Liu | |
| 5,220,906 | A | 6/1993 | Choma | |
| 5,243,956 | A | 9/1993 | Luehring | |
| 5,433,186 | A | 7/1995 | Corwin | |
| 5,437,260 | A | 8/1995 | King | |
| 5,445,139 | A | 8/1995 | Bybee | |
| 5,553,596 | A | 9/1996 | Bednar | |
| 5,598,829 | A | 2/1997 | Bednar | |
| 5,649,520 | A | 7/1997 | Bednar | |
| 5,678,528 | A | 10/1997 | Hadley | |
| 5,853,001 | A | 12/1998 | Vyprachticky | |
| 5,987,724 | A | 11/1999 | Kleman | |
| 6,095,128 | A | 8/2000 | Bednar | |
| 6,286,496 | B1 | 9/2001 | Bednar | |
| 6,874,491 | B2 | 4/2005 | Bednar | |
| 6,913,007 | B2 | 7/2005 | Bednar | |
| 7,100,590 | B2 | 9/2006 | Chang | |
| 7,178,514 | B2 | 2/2007 | Chang | |
| 7,624,725 | B1 | 12/2009 | Choma | |
| 7,784,453 | B1 | 8/2010 | Yehle | |
| 8,443,790 | B2 | 5/2013 | Pestrue | |
| 8,499,753 | B2 | 8/2013 | Bednar | |
| 9,097,485 | B2 * | 8/2015 | Lipowski | F41A 17/46 |
| 9,234,719 | B1 | 1/2016 | Kempf | |
| 9,726,448 | B1 * | 8/2017 | Milde, Jr. | F41A 35/00 |
| 10,317,157 | B2 * | 6/2019 | Bowers | F41A 17/066 |
| 2006/0086346 | A1 | 4/2006 | Middleton | |
| 2010/0170488 | A1 | 1/2010 | Rasor et al. | |
| 2011/0056467 | A1 | 3/2011 | Popov et al. | |
| 2016/0054081 | A1 * | 2/2016 | Creed | F41A 17/066 42/70.06 |

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

CROSSBOW SAFETY SYSTEM

CROSS-REFERENCE TO RELATED APPLICATIONS

This application is a continuation of U.S. patent application Ser. No. 15/893,876, filed Feb. 12, 2018, which claims the benefit of U.S. Provisional Application No. 62/478,290, filed Mar. 29, 2017, the entirety of each of which are fully incorporated by reference herein.

I. BACKGROUND

The present subject matter is directed to crossbows. More specifically the present subject matter is directed to an interlock system for a crossbow to prevent unsafe operation.

There are multiple technical challenges present in current crossbow technology. Some of these challenges relate to user safety and satisfaction. Unlike some other conventional weapons, a crossbow may present an opportunity for a user to grip the weapon in a way that positions a body part, such as the user's finger or other portion of the user's hand, in the path of the bowstring of the crossbow as it moves from the cocked to the uncocked positions during firing. Such positioning of a body part in the path of the bowstring may lead to undesirable performance and potential user injury.

It remains desirable to provide an interlock system for a crossbow that helps to prevent unsafe or otherwise undesirable operation.

II. SUMMARY

In accordance with one aspect of the present subject matter provided is a crossbow safety system comprising a crossbow, a pressure sensor, and an interlock. The crossbow has a bowstring operable between a cocked and an uncocked position, a foregrip adapted for being grasped by an associated hand of an associated user, and a trigger assembly adapted to selectably retain the bowstring in the cocked position. The pressure sensor is on or in the foregrip, and is adapted to detect a pressure signature from the foregrip being grasped by an associated hand of an associated user, the associated hand having fingers. The interlock is operationally engaged with the pressure sensor and the trigger assembly, and is adapted to lock the trigger assembly from releasing the bowstring if the pressure sensor does not detect a first pressure signature sufficiently similar to a predetermined pressure signature.

Still other benefits and advantages of the present subject matter will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
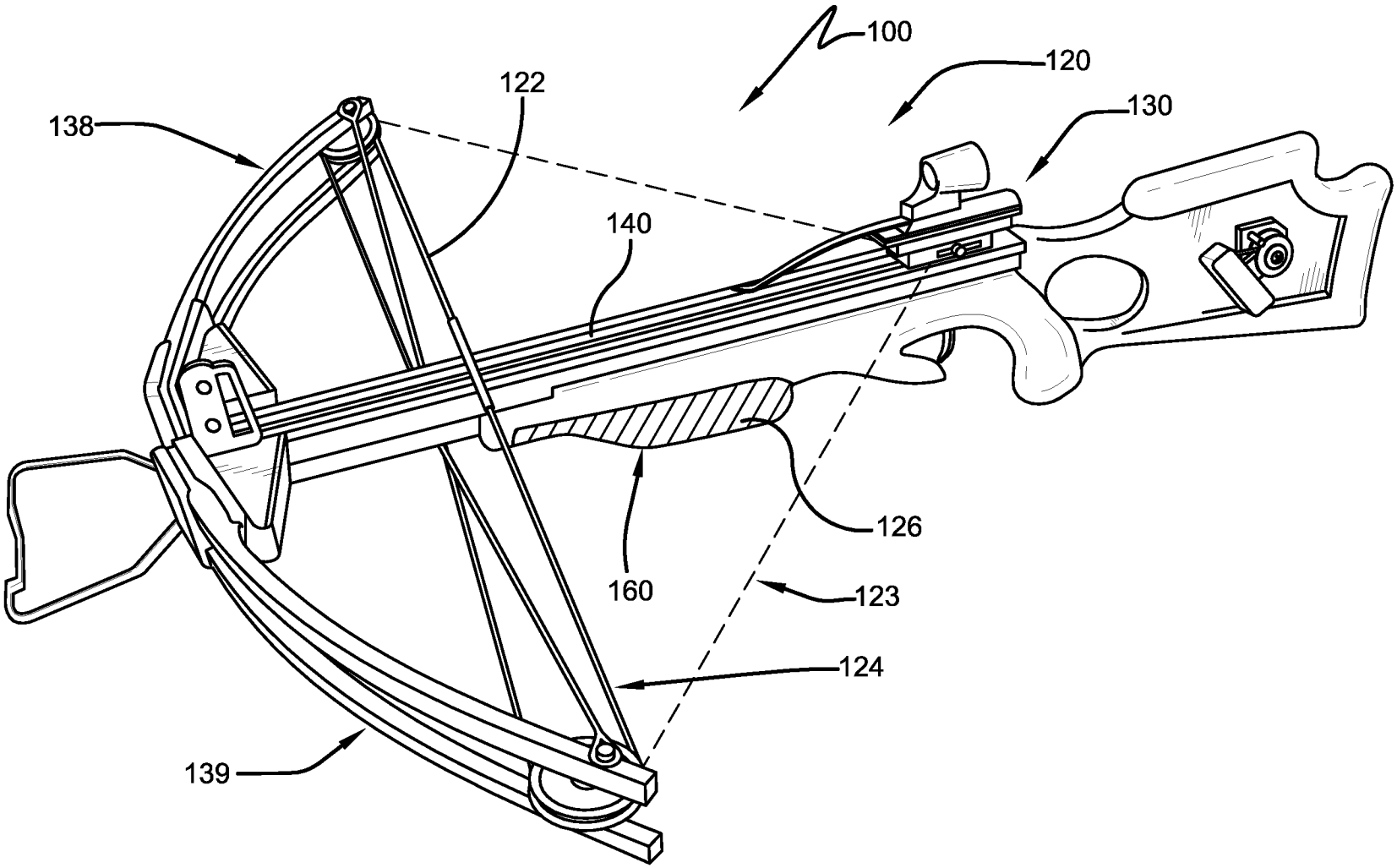
FIG. 1 is a perspective view of one embodiment of a crossbow safety system.
Figure 2:
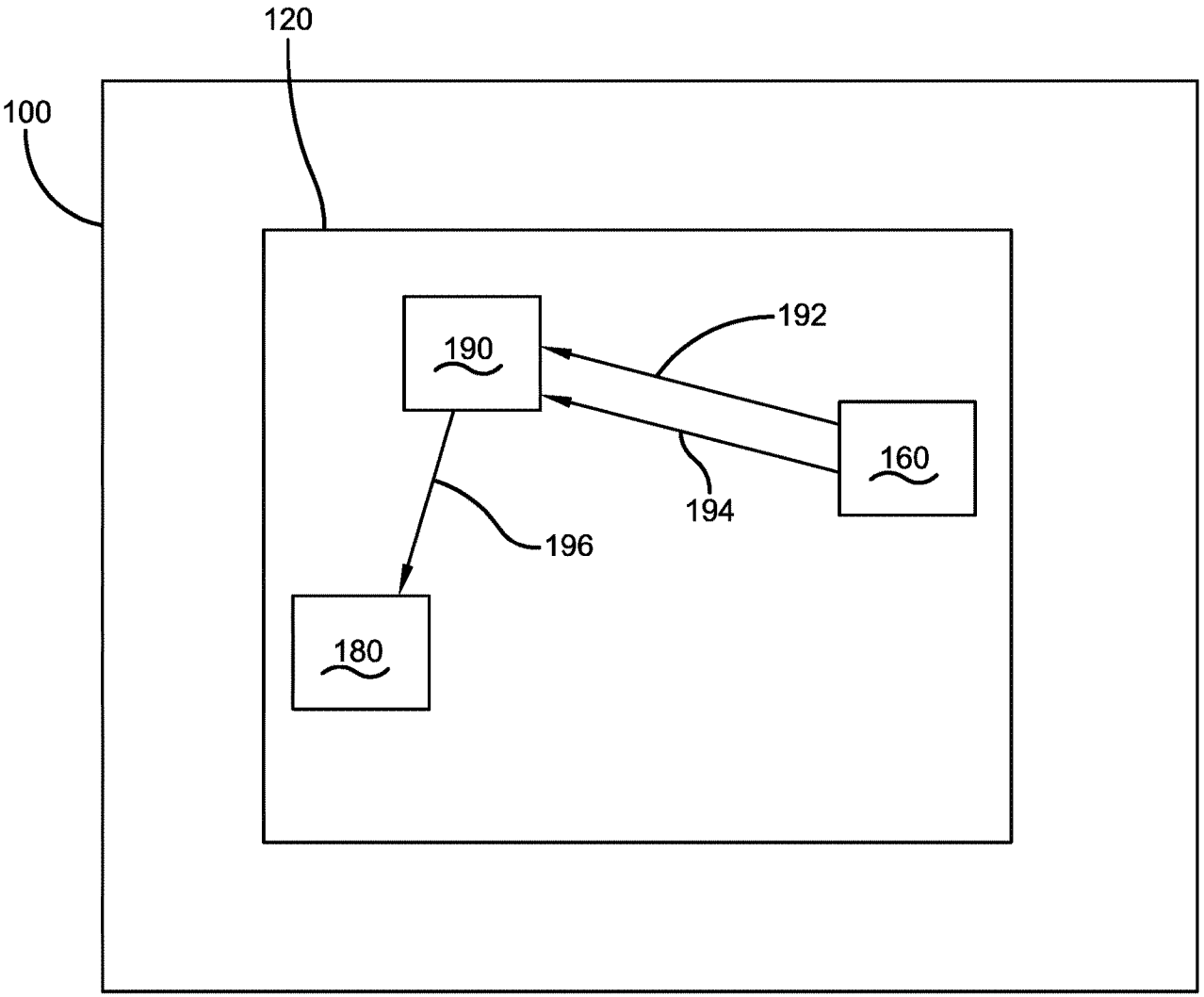
FIG. 2 is a schematic diagram of the components in one embodiment of a crossbow safety system.

Referring now to the drawings wherein the showings are for purposes of illustrating embodiments of the present subject matter only and not for purposes of limiting the same, and wherein like reference numerals are understood to refer to like components, provided is a crossbow safety system and a method for using same.

In a first embodiment, a crossbow safety system 100 may comprise a crossbow 120, a pressure sensor 160, and an interlock 180.

The crossbow 120 may comprise a bowstring 122, a foregrip 126, and a trigger assembly 130. The bowstring 122 may be operable between a cocked position 123 and an uncocked position 124. In one non-limiting embodiment, the bowstring 122 extends between a set of crossbow limbs 138, 139 and may be moved between the cocked position 123 and the uncocked position 124 by moving a section of the bowstring 122 along the beam 140. The trigger assembly 130 may be adapted to selectably retain the bowstring 122 in the cocked position 123. The crossbow is discharged, and any associated arrow operatively engaged with the bowstring 122 is fired, by triggering the crossbow 120. This triggering may also be called a firing operation. Triggering the crossbow 120 causes the trigger assembly 130 to release the bowstring 122 from the cocked position 123. The crossbow 120 may have a foregrip 126. A foregrip is adapted to be grasped by an associated hand of an associated user during operation. One common use of the foregrip 126 is to support the crossbow during a firing operation.

The pressure sensor 160 may be operatively engaged with the foregrip 126 of the crossbow 120 and be on or in the foregrip of the crossbow 120. The pressure sensor 160 may be adapted to detect a pressure signature resulting from the foregrip 126 being grasped by an associated hand of an associated user. The associated hand will have one or more fingers and the pressure sensor may be adapted to determine as part of the pressure signature: the number of fingers of the associated hand, or a palm print or a finger print of the associated hand or finger thereof, or a pressure distribution over the associated hand of the associated user, or some combination thereof. The pressure sensor 160 may comprise or be a resistive sensor, a capacitive sensor, or an inductive sensor. In some embodiments in which the pressure sensor 160 comprises a resistive sensor, the pressure sensor 160 may be a resistive sensor having a piezoresistive integrated semiconductor.

In some non-limiting embodiments the pressure sensor 160 is operatively engaged with a computer 190. In some non-limiting embodiments the computer 190 may be a cellular phone, or tablet, or other device. The operational engagement between the pressure sensor 160 and the computer 190 may be by any Bluetooth, infrared, radio signal, or any other wired or wireless communication device or method adapted to operationally interface the pressure sensor 160 and the computer 190 chosen with good engineering judgment. The computer 190 may be adapted to store a predetermined pressure signature 192 and compare information about any subsequently detected pressure signature 194 to the predetermined pressure signature 192. In application, the system may have a teaching mode, in which the predetermined pressure signature 192 is established and stored, and an operational mode in which it is adapted to detect a pressure signature 194 and compare it to the predetermined pressure signature 192. In some embodiments, the computer 190 may also have information, one or more parameters or otherwise, stored that establish the degree to which any subsequently detected pressure signature 194 is similar to the predetermined pressure signature 192 and the limits of deviation from the predetermined pressure signature 192 permitted for any subsequently detected pressure signature 194 to be determined to be sufficiently similar to a predetermined pressure signature 192.

The interlock 180 is operationally engaged with the pressure sensor 160 and the trigger assembly 130. The interlock 180 is adapted to lock the trigger assembly 130 from releasing the bowstring 122 if the pressure sensor 160 does not detect a pressure signature 194 sufficiently similar to a predetermined pressure signature 192. In certain embodiments, the interlock 180 will lock the trigger assembly 130 from releasing the bowstring 122 unless it receives a release signal 196 from the computer 190 to release the interlock 180 and the computer 190 will only provide the release signal 196 to the interlock 180 if the pressure sensor 160 detects a pressure signature 194 sufficiently similar to a predetermined pressure signature 192.

In operation, a crossbow safety system 100 may be operated by providing a crossbow safety system 100 as described above; grasping the foregrip 126 with the associated hand of an associated user; detecting with the pressure sensor 160 the pressure signature 194 from the foregrip 126 being grasped by the associated hand of the associated user; comparing the pressure signature 194 detected to a predetermined pressure signature 192; and operating the interlock 180. Operation of the interlock 180 locks the trigger assembly 130 from releasing the bowstring 122 if the pressure signature 194 detected is not sufficiently similar to a predetermined pressure signature 192. Operation of the interlock 180 unlocks the trigger assembly 130 to permit release of the bowstring 122 if the pressure signature 194 detected is sufficiently similar to a predetermined pressure signature 192. In one application, the predetermined pressure signature 192 requires that the associated user position his associated hand and all associated fingers thereof in such a way that the associated fingers and hand cannot be in the path of the bowstring as it moves from the cocked position to the uncocked position.

Non-limiting embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

We claim:

1. A crossbow safety system comprising:

a crossbow having a bowstring operable between a cocked and an uncocked position, a foregrip adapted for being grasped by a first associated hand of an associated user, hereinafter a non-trigger hand;

a trigger assembly adapted to selectably retain the bowstring in the cocked position and adapted for being operated by a second associated hand of the associated user, hereinafter a trigger hand;

a pressure sensor on or in the foregrip, the pressure sensor being adapted to detect a pressure signature from the foregrip being grasped by the non-trigger hand of the associated user; and an interlock operationally engaged with the pressure sensor and the trigger assembly, the interlock being adapted to lock the trigger assembly from releasing the bowstring when the trigger hand engages the trigger assembly if the pressure sensor does not detect a first pressure signature from the non-trigger hand sufficiently similar to a predetermined pressure signature.

2. The crossbow safety system of claim 1 wherein:

the bowstring follows a path between the cocked and uncocked positions; and the interlock is adapted to lock the trigger assembly from releasing the bowstring based on the relative positioning of the associated user's non-trigger hand and all associated fingers of the non-trigger hand with respect to the path.

3. The crossbow safety system of claim 2 wherein:

the interlock is adapted to lock the trigger assembly from releasing the bowstring when any portion of the associated user's non-trigger hand, including all associated fingers of the non-trigger hand, are in the path.

4. The crossbow safety system of claim 1 further comprising:

a computer operationally engaged with the pressure sensor and adapted to store the predetermined pressure signature and compare information about the detected pressure signature to the predetermined pressure signature.

5. The crossbow safety system of claim 1 wherein:

the predetermined pressure signature includes the number of fingers of the associated user's non-trigger hand.

6. The crossbow safety system of claim 1 wherein:

the predetermined pressure signature includes at least one of a palm print and a finger print.

7. The crossbow safety system of claim 1 wherein:

the predetermined pressure signature includes a pressure distribution over the non-trigger hand of the associated user.

8. A crossbow safety system method comprising the steps of:

A) providing a crossbow having a bowstring operable between a cocked and an uncocked position, a foregrip adapted for being grasped by a first associated hand of an associated user, hereinafter a non-trigger hand, and a trigger assembly adapted to selectably retain the bowstring in the cocked position and adapted for being operated by a second associated hand of the associated user, hereinafter a trigger hand;

B) providing a pressure sensor on or in the foregrip, the pressure sensor being adapted to detect a pressure signature from the foregrip being grasped by the non-trigger hand of the associated user;

C) providing an interlock operationally engaged with the pressure sensor and the trigger assembly; and D) providing the interlock to be operable to lock the trigger assembly from releasing the bowstring when the trigger hand engages the trigger assembly if the pressure sensor does not detect a first pressure signature from the non-trigger hand sufficiently similar to a predetermined pressure signature.

9. The crossbow safety system method of claim 8 wherein:

step A) comprises the step of: providing the bowstring to be movable between the cocked and the uncocked positions along a path; and step D) comprises the step of: providing the interlock to lock the trigger assembly from releasing the bowstring based on the relative positioning of the associated user's non-trigger hand and all associated fingers of the non-trigger hand with respect to the path.

10. The crossbow safety system method of claim 8 wherein step D) comprises the step of:

providing the interlock to be operable to lock the trigger assembly from releasing the bowstring when any portion of the associated user's non-trigger hand, including all associated fingers of the non-trigger hand, are in the path.

11. The crossbow safety system method of claim 8 wherein the method further comprises the step of:

providing a computer operationally engaged with the pressure sensor and adapted to store the predetermined pressure signature and compare information about the detected pressure signature to the predetermined pressure signature.

12. The crossbow safety system method of claim 8 wherein:

the predetermined pressure signature includes the number of fingers of the associated user's non-trigger hand.

13. The crossbow safety system method of claim 8 wherein:

the predetermined pressure signature includes at least one of a palm print and a finger print.

14. The crossbow safety system method of claim 8 wherein:

the predetermined pressure signature incudes a pressure distribution over the non-trigger hand of the associated user.

15. A crossbow safety system comprising:

a crossbow having a bowstring operable to follow a path between a cocked and an uncocked position, a foregrip adapted for being grasped by an associated hand of an associated user, and a trigger assembly adapted to selectably retain the bowstring in the cocked position;

a pressure sensor on or in the foregrip, the pressure sensor being adapted to detect a pressure signature from the foregrip being grasped by the associated hand of the associated user, the associated hand having fingers;

an interlock operationally engaged with the pressure sensor and the trigger assembly, the interlock being adapted to lock the trigger assembly from releasing the bowstring if the pressure sensor does not detect a first pressure signature sufficiently similar to a predetermined pressure signature; and wherein the predetermined pressure signature requires only the relative positioning of the associated user's associated hand and all associated fingers with respect to the path.

16. The crossbow safety system of claim 15 wherein:

the foregrip is adapted for being grasped by a first associated hand of an associated user, hereinafter a non-trigger hand;

the trigger assembly is adapted for being operated by a second associated hand of the associated user, hereinafter a trigger hand;

the pressure sensor is adapted to detect a pressure signature from the foregrip being grasped by the non-trigger hand of the associated user; and the interlock is: operationally engaged with the pressure sensor and the trigger assembly; and is adapted to lock the trigger assembly from releasing the bowstring when the trigger hand engages the trigger assembly if the pressure sensor does not detect a first pressure signature from the non-trigger hand sufficiently similar to a predetermined pressure signature.

17. The crossbow safety system of claim 15 wherein:

the interlock is adapted to lock the trigger assembly from releasing the bowstring when any portion of the associated user's hand, including all associated fingers of the associated hand, are in the path.

18. The crossbow safety system of claim 15 further comprising:

a computer operationally engaged with the pressure sensor and adapted to store the predetermined pressure signature and compare the first detected pressure signature to the predetermined pressure signature.

19. The crossbow safety system of claim 15 wherein the predetermined pressure signature includes at least one of:

a palm print of the associated user's associated hand; and a finger print of the associated user's associated hand.

20. The crossbow safety system of claim 15 wherein the predetermined pressure signature includes at least one of:

the number of fingers of the associated user's associated hand; and a pressure distribution over the associated hand of the associated user.

* * * * *